United States Patent [19]

Wicks

[11] Patent Number: 4,516,876

[45] Date of Patent: May 14, 1985

[54] PRECAST CONCRETE EXPANSION JOINT FOR ROADS AND THE LIKE

[76] Inventor: Harry O. Wicks, 5563 Meadow Dr., Hamburg, N.Y. 14075

[21] Appl. No.: 456,554

[22] Filed: Jan. 10, 1983

[51] Int. Cl.[3] ..... E01C 11/14

[52] U.S. Cl. ..... 404/60; 404/74; 404/51; 264/35; 52/403; 52/573; 52/378

[58] Field of Search ..... 404/63, 60, 62, 56, 404/68, 74; 52/601, 403, 729, 573, 604, 605, 378; 264/35

[56] References Cited

U.S. PATENT DOCUMENTS

| | | | |
|---|---|---|---|
| 1,197,815 | 9/1916 | Frost | 52/595 |
| 2,093,697 | 9/1937 | Scholer | 404/62 |
| 2,138,817 | 12/1938 | Jacobson | 404/68 |
| 2,244,337 | 6/1941 | Isett | 404/63 |
| 2,448,134 | 8/1948 | Abel | 404/63 |
| 3,368,016 | 2/1968 | Birguer | 264/35 |

*Primary Examiner*—James A. Leppink
*Assistant Examiner*—Mark J. DelSignore
*Attorney, Agent, or Firm*—Ralph Hammar

[57] ABSTRACT

Expansion joints for concrete highways consisting of precast beams with preformed joints of expansion joint material. The beams are laid crosswise of a strip of highway before pouring the concrete and provide expansion joints which are not affected by the skill of the workmen.

10 Claims, 3 Drawing Figures

PRECAST CONCRETE EXPANSION JOINT FOR ROADS AND THE LIKE

Figure 1:
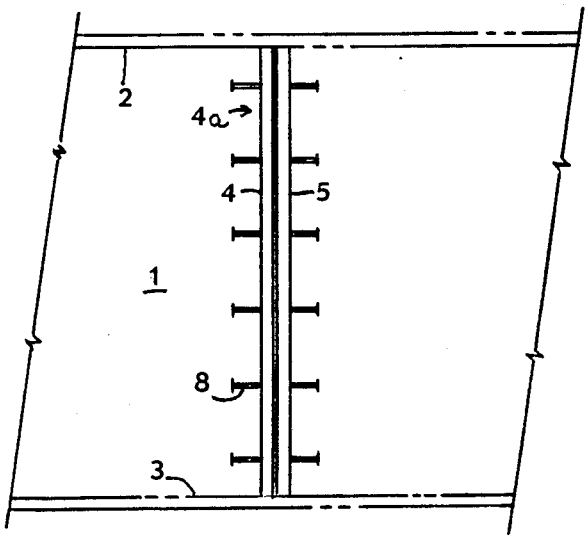

Under current practice in highway construction, twelve foot wide concrete lanes are poured in continuous lengths. After the cement has initially set, at intervals transverse cuts are made across the width of the lane. The initial cuts are ¼" wide and about one-third the depth of the pavement. The purpose of the initial cuts is to weaken the slab and cause the slab to crack in the plane of the cut through the full depth of the slab upon solidification of the concrete. The outer two inches of each cut is then widened by sawing to a width appropriate for the expansion joint material to be inserted. The expansion joint may be an extruded neoprene or other elastomeric strip or it may be a semiliquid material such as tar which is poured into the groove. There are diverse specifications for expansion joints. The results obtained are dependent upon the skill of the workmen.

This invention is intended to overcome the problems by a joint construction consisting generally of a precast concrete beam extending the full width of the lane which includes the expansion joint. The concrete beams may be reinforced if required by the specification of the road building agency. The joint may be left open, to be filled with a semiliquid tar-like material, or it may be prefilled with a neoprene strip bonded to opposite sides of the joint. In either case, the concrete beams and joints are manufactured under controlled factory conditions and the behavior of the joint material in service is not dependent upon the skill of the workmen.

Figure 2:
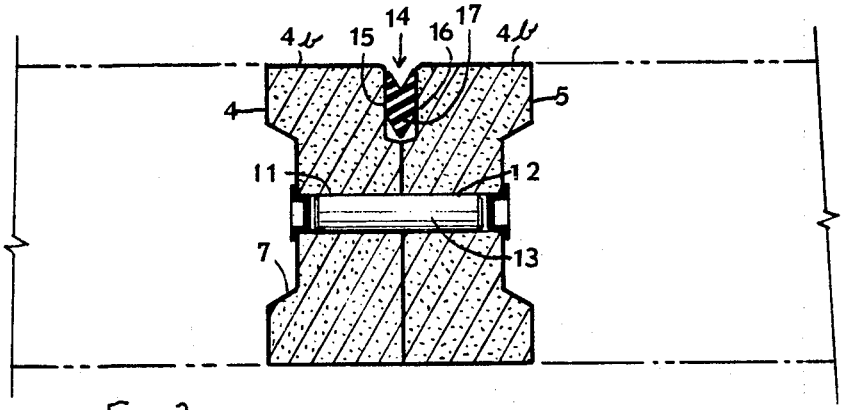
Figure 3:
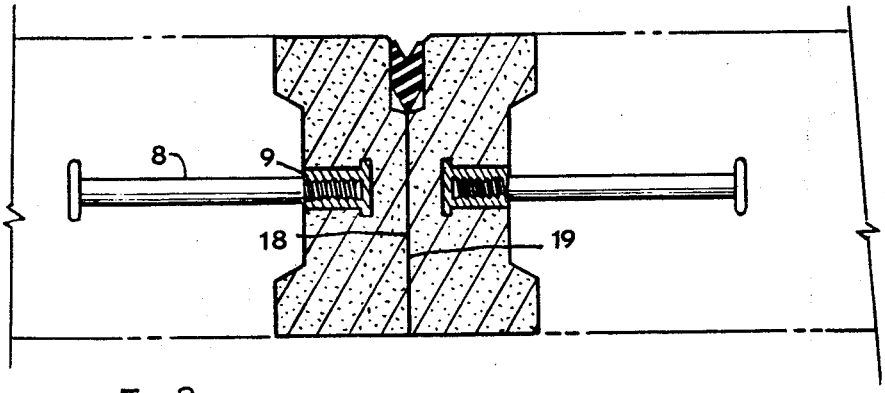

In the drawing,

FIG. 1 is a plan view of a roadway slab or lane including an expansion joint, FIG. 2 is a section through the expansion joint taken at one of the dowels, and FIG. 3 is a section of the expansion joint showing the concrete anchors.

Referring to the drawing, 1 indicates the prepared roadbed on which the concrete roadway is to be poured, 2, 3 indicate the forms extending along the sides of the roadway. The height of the forms 2, 3 above the roadbed is equal to the depth of the roadway to be poured, and the spacing between the forms is equal to the width of the roadway. At suitable intervals along the forms, expansion joints must be provided to take care of the thermal expansion and contraction of the roadway slab. These expansion joints are provided by precast concrete beams 4*a* which may be made in two parts 4, 5. The beams have a length equal to the width of the roadway and a depth equal to the depth of the roadway slab, and have upper surfaces 4*b* level with the surface of the roadway slab. The beams rest on the prepared roadbed 1. Each beam has a longitudinal external groove 7 on opposite sides receiving the poured cement and providing shear keys for anchoring the beam into the roadway slab. Further anchorage is provided by anchors 8 screwed into inserts 9 in the parts 4, 5. The anchors are removed for shipping. At suitable intervals, the parts 4, 5 are provided with aligned holes 11, 12 receiving dowel pins 13 for guiding the movement of the parts toward and away from each other during expansion and contraction of the roadway slab. The outer ends of the holes are plugged during pouring to exclude cement. The parts 4, 5 cooperate to form a groove 14 having vertical sides 15, 16 bonded to opposite sides of an elastomeric strip 17 of expansion joint material. The strip conveniently is made of neoprene. As the beams are initially installed between the forms 2, 3, the surfaces 18, 19 are close together and may be in substantial contact with each other.

During pouring, the paving machine pours cement level with the upper edges of the forms 2, 3 and with the upper surfaces of the beams 4*a*. The machine pours a continuous ribbon. As the cement cures, it shrinks and the surfaces 15, 16 and 18, 19 on the beams pull away from each other, due to the contraction of the cement during curing. The thermal expansion is less than the curing shrinkage. The parts 4, 5 being anchored to the cement by the reinforcing rods 8 and hooks 9 move with the cement as it contracts during curing. The skin of concrete over the upper edge of the rubber strip 17 quickly breaks away and in any event is so weak that it would not withstand the thermal expansion forces generated by the concrete roadway slabs.

For highways which do not specify the neoprene strips for the expansion joints, the strips are omitted and the beams are assembled upon the same spacing as shown in FIG. 2 with the space between the surfaces 15, 16 suitably blocked by removable material so that cement will not enter between these spaces as the roadway is poured. After the cement has initially set, the blocking material can be easily removed and the space between the surfaces 15, 16 filled by the viscous or tar-like material required. For any type of road construction, the expansion joint eliminates the human factor present in current construction and provides superior operation.

I claim:

1. For use in a poured concrete roadway of the type requiring at least one expansion joint at a predetermined location along the length of the roadway, and having forms at opposite sides of the roadway defining the depth of the concrete to be poured, a precast concrete beam to be installed in said forms at said location requiring an expansion joint, said beam having its length and depth corresponding to the width and depth of the concrete to be poured and having its upper surface flush with the concrete to be poured, said beam remaining in place in the poured concrete as a permanent part of the road, and said beam having opposite sides consisting of separate precast units of concrete movable toward and away from each other and cooperating to form an expansion joint groove in said upper surface extending between said forms.

2. The structure of claim 1 plus means for blocking the flow of cement into said groove in quantity sufficient to interfere with the expansion joint means.

3. The structure of claim 2 in which the blocking means is easily removable after pouring to permit filling the groove with flowable material.

4. The structure of claim 2 in which the blocking means is a strip of elastomer filling and bonded to opposite sides of the groove.

5. For use in a poured concrete roadway of the type requiring at least one expansion joint at a predetermined location along the length of the roadway, and having forms at opposite sides of the roadway defining the depth of the concrete to be poured, a precast concrete beam to be installed in said forms at said location requiring an expansion joint, said beam having its length and depth corresponding to the width and depth of the concrete to be poured and having its upper surface flush with the concrete to be poured, said beam remaining in place in the poured concrete as a permanent part of the road, and said beam having opposite sides consisting of separate precast units of concrete movable toward and away from each other, and cooperating to form an expansion joint groove in said upper surface extending between said forms means on said opposite sides of the beam for anchoring the same to the poured concrete whereby expansion and contraction of the concrete moves opposite sides of the beam toward and away from each other.

6. The structure of claim 5 in which the anchoring means comprises pins secured to opposite sides of the beam which are removable for shipment.

7. The structure of claim 1 in which the beam is in two halves, which are separate precast units of concrete, one half comprising one side of the beam and one side of the groove, and the other half comprising the opposite side of the beam and the opposite side of the groove.

8. The structure of claim 7 in which the halves are slidably doweled together for said movement toward and away from each other.

9. The method of laying a concrete road which comprises the steps of positioning a precast concrete beam in the forms at each location at which an expansion joint is required between leading and trailing sections of the road, said beam having its upper surface level with the surface of the road and its opposite sides consisting of separate precast units of concrete respectively movable toward and away from each other and presented to said leading and trailing sections of the road and an expansion joint between said sides and having a groove in said surface with the leading and trailing sides of the groove movable toward and away from each other, pouring cement in said forms level with the upper surface of the beam, and leaving the beam in place as a permanent part of the road.

10. The method of claim 9 in which the flow of cement into said groove is blocked during pouring.

* * * * *